United States Patent [19]

Höptner et al.

[11] Patent Number: 4,941,449

[45] Date of Patent: Jul. 17, 1990

[54] FUEL INJECTION PROCESS

[75] Inventors: Wolfgang Höptner, Uhingen; Egbert Perenthaler, Stuttgart; Helmut Schwarz, Vaihingen, all of Fed. Rep. of Germany

[73] Assignee: Robert Bosch GmbH, Stuttgart, Fed. Rep. of Germany

[21] Appl. No.: 301,752

[22] PCT Filed: Jun. 23, 1987

[86] PCT No.: PCT/DE87/00281

§ 371 Date: Jan. 5, 1989

§ 102(e) Date: Jan. 5, 1989

[87] PCT Pub. No.: WO88/00287

PCT Pub. Date: Jan. 14, 1988

[30] Foreign Application Priority Data

Jul. 9, 1986 [DE] Fed. Rep. of Germany ..... 3623042

[51] Int. Cl.[5] ..... F02D 41/36; F02D 41/06

[52] U.S. Cl. ..... 123/490; 123/491

[58] Field of Search ..... 123/490, 491, 179 L

[56] References Cited

U.S. PATENT DOCUMENTS

| | | | |
|---|---|---|---|
| 4,418,674 | 12/1983 | Hasegawa et al. | 123/491 |
| 4,515,131 | 5/1985 | Suzuki et al. | 123/491 |
| 4,528,960 | 7/1985 | Mizuno et al. | 123/478 |

FOREIGN PATENT DOCUMENTS

| | | | |
|---|---|---|---|
| 0115827 | 8/1984 | European Pat. Off. . | |
| 0176359 | 4/1986 | European Pat. Off. . | |
| 0204220 | 12/1986 | European Pat. Off. . | |
| 60-3456 | 1/1985 | Japan | 123/491 |

*Primary Examiner*—Andrew M. Dolinar

*Attorney, Agent, or Firm*—Michael J. Striker

[57] ABSTRACT

In a process for fuel injection in a multiple-cylinder internal combustion engine, opening signals for the respective injection valves of the individual cylinders are produced as a function of reference signals which are synchronous with the crankshaft. All injection valves are first controlled jointly after the ignition switch is switched on and the sequential opening signals for the sequential fuel injection are produced after the synchronization has been recognized. In order that the sequential fuel injection be switched on rapidly after the start of the internal combustion engine or after a disruption of the synchronization, wherein the fuel quantity injected into opened inlet valves is to be minimized, the opening signals are fed to the injection valves in a simultaneous manner, at least in a phase (a) until the synchronization has been recognized. In addition, the opening signals are simultaneously fed to the injection valves of those cylinders in a phase (b) which have not yet been changed over to sequential operation.

7 Claims, 1 Drawing Sheet

FUEL INJECTION PROCESS

PRIOR ART

The invention is directed to a process for fuel injection in a multiple-cylinder internal combustion engine, wherein opening signals for the respective injection valves of the individual cylinders are produced as a function of the reference signals which are synchronous with the crankshaft, and all injection valves are first simultaneously opened once after the ignition switch is switched on and then the sequential opening signals for the sequential fuel injection are produced after the synchronization has been recognized.

An electronic fuel injection control system is known from DE-OS 32 43 456 in which all fuel injection valves are opened simultaneously immediately after closing an ignition switch in order to guide fuel to all cylinders of the internal combustion engine However, all fuel injection valves remain closed thereafter until the pistons of the cylinders have executed an intake stroke and the synchronization has been recognized. After the synchronization has been recognized, the fuel injection valves are opened successively in a preset sequence as a function of the reference signals which are synchronous with the crankshaft, and fuel is injected into the respective cylinder. The opening time during the mutual initial opening of all injection valves corresponds to the opening time after the synchronization has been recognized. A relatively large quantity of fuel is injected into opened inlet valves. No additional fuel reaches the respective combustion chambers until the start of the sequential fuel injections after the synchronization.

ADVANTAGES OF THE INVENTION

The process for fuel injection, according to the invention, is characterized in that during starting or after a disruption of the synchronization simultaneous, additional opening signals are fed to the injection valves, in a phase (a) until the synchronization has been recognized, and in that the additional simultaneous opening signals are fed to the injection valves in a phase (b) after the synchronization has been recognized for the cylinders which are not yet changed over to sequential operation. The invention provides the advantage of rapid switching over to sequential fuel injection. After starting or after a disruption of the synchronization, respectively, the allocation of fuel is effected simultaneously via all injection valves during a first phase, specifically so as to be delayed by a period of time t1 relative to the reference signal and in a relatively short opening interval T1 which can be preset. The opening interval T1 is smaller, according to the invention, than after the synchronization and depends particularly on the engine temperature, speed and the number of cylinders. There is an improved cold start behavior when the fuel injection into opened inlet valves is minimized. After the synchronization has been recognized, the injection is successively changed over to sequential operation, whereby fuel continues to be allocated to the rest of the cylinders, which are not yet synchronized, in parallel or simultaneous operation until the moment of the first closing of the corresponding inlet valves. Consequently, a fuel-air mixture is always present in the combustion chamber.

DRAWING

The process, according to the invention, is explained in more detail in connection with the following description with the aid of the drawing where:

FIG. 1 shows a time-dependency diagram with the signals for opening the injection valves of an internal combustion engine with six cylinders, wherein the successive fuel injection is effected after the recognition of the reference signal of the first cylinder, and FIG. 2 shows a time-dependency diagram similar to FIG. 1, wherein, however, synchronization also takes place additionally after the recognition of the reference signal of the fourth cylinder.

DESCRIPTION OF THE PREFERRED EMBODIMENTS

Figure 1:
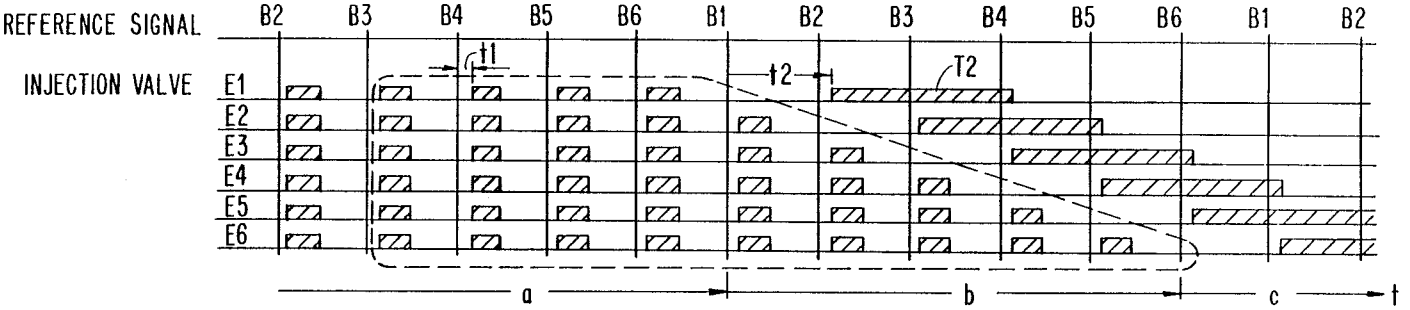

FIG. 1 shows the time-dependency diagram of the signals for opening the injection valves E1 to E6 of an internal combustion engine with six cylinders. In the topmost line, the reference marks or reference signals B1 to B6 of the respective cylinders 1 to 6 are indicated. As known, an in-phase allocation of fuel is not possible when starting the internal combustion engine or after a disruption of the synchronization between the internal combustion engine and the control unit by means of which the fuel injection is implemented. Thus, it is assumed by way of example that after starting the internal combustion engine the reference signal B2 for the second cylinder first occurs. When this happens, the first ignition is effected as shown in the bottommost line. An opening signal, and accordingly the allocation of fuel in all cylinders, is now effected in a first phase "a" simultaneously for all injection valves. The opening signals are delayed by a time t1 relative to the reference signals B2 to B6 which are synchronous with the crankshaft. The delay time t1 depends particularly on the engine temperature and speed. Within the framework of this invention, the duration T1 of the simultaneous opening signals is substantially smaller than the opening time T2 after the synchronization is effected The opening time T1 is particularly dependent on the engine temperature, the speed and the number of cylinders. A minimizing of the fuel injection into opened inlet cylinders is achieved, so that a good cold starting behavior is achieved.

The synchronization is recognized with the occurrence of the reference signal B1 for the first cylinder. After the synchronization has been recognized, the fuel injection is now successively switched over to sequential operation. During this change-over phase b, fuel continues to be allocated to the rest of the cylinders in parallel or simultaneous operation until the moment of the first closing of the corresponding inlet valves. The sequential fuel injections are effected so as to be delayed in each instance by delay time t2 relative to the respective reference signals B1 to B6. This delay time t2 and the opening time T2 depend, in the usual manner, on the parameters to be taken into consideration for the fuel injection and specifically chiefly on the engine speed, the load, engine temperature, lambda and the acceleration. In the following phase "c", the sequential fuel injection is effected exclusively. The short simultaneous injections or openings T1 enclosed by the dashed lines are carried out, according to the invention, in addition to the short simultaneous injections or openings of the valves after the first reference signal B2.

Figure 2:
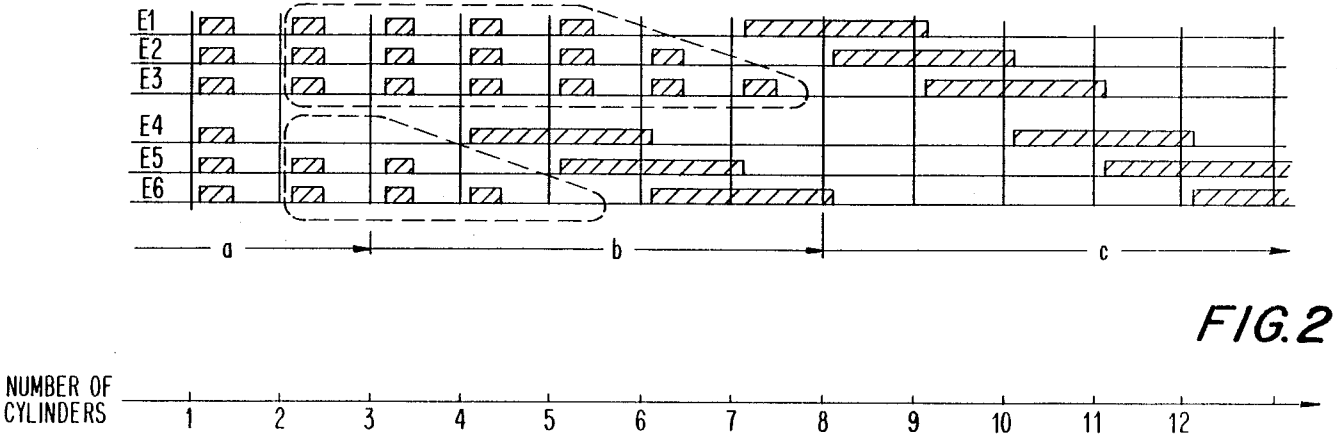

FIG. 2 shows a particular modification in which the synchronization is effected not only by means of the recognition of reference signal B1 assigned to the first cylinder, but also additionally by means of the recognition of reference signal B4 assigned to the fourth cylinder. In this embodiment, in general, cylinder 1 or cylinder $M=N/2+1$ are utilized for recognition, wherein N is the total number of cylinders. The synchronization accordingly starts considerably earlier, namely after the third ignition in this embodiment example. Because of the rapid switching over to the sequential fuel injection, there is a further minimization of the fuel injection into opened inlet valves.

We claim:

1. Process for fuel injection in a multiple-cylinder internal combustion engine, wherein opening signals for the respective injection vales of the individual cylinders are produced as a function of the reference signals which are synchronous with the crankshaft, and all injection valves are first opened simultaneously once after the ignition is switched on and then sequential opening signals for the sequential fuel injection are produced after the synchronization has been recognized, characterized in that during starting or after a disruption of the synchronization, additional simultaneous opening signals are fed to the injection valves in a phase (a) until the synchronization is recognized, and in that the additional simultaneous opening signals are fed, after the synchronization has been recognized in a phase (b), to the injection valves of the cylinders which are not yet opened during sequential operation.

2. Process according to claim 1, characterized in that the additional simultaneous opening signals are fed to the respective injection valves during every ignition in phase (b).

3. Process according to claim 1, characterized in that the duration (T1) of the simultaneous opening signals is substantially smaller than the opening times (T2) of the sequential opening signals after synchronization is achieved.

4. Process according to claim 1, characterized in that the recognition of the synchronization is effected in cylinder 1 and in at least one other cylinder, particularly in the cylinder $M=N/2+1$, wherein N is the total number of cylinders.

5. Process for fuel injection in a multiple-cylinder internal combustion engine, wherein opening signals for the respective injection valves of the individual cylinders are produced as a function of the reference signals which are synchronous with the crankshaft, and all injection valves are first opened simultaneously once after the ignition switch is switched on and the sequential opening signals for the sequential fuel injection are produced after the synchronization has been recognized, characterized in that during starting or after a disruption of the synchronization, additional simultaneous opening signals are fed to the injection vales in a phase (a) until the synchronization in cylinder 1 is recognized; that additional simultaneous opening signals are fed in a phase (b) after the synchronization has been recognized, to the injection valves for the cylinders which are not yet opened by the sequential opening signals; that the simultaneous opening signals are time delayed relative to the preceding reference signal by a time (t1) which depends on the engine temperature and speed; that the sequential opening signals are time delayed relative to the assigned preceding reference signal by a time (t2) which depends on the engine temperature, speed, load, lambda and acceleration; and that the recognition of the synchronization is effected in at least one other cylinder, particularly in the cylinder $M=N/2+1$, wherein N is the total number of cylinders.

6. Process according to claim 5, characterized in that the additional opening signals are fed to the respective injection valves during every ignition in phase (a) and in phase (b).

7. Process according to claim 6, characterized in that the duration (T1) of the opening signals during the phases (a) and (b) are substantially smaller than the opening times (T2) after synchronization is achieved.

* * * * *